US010890139B2

(12) United States Patent
Davis

(10) Patent No.: US 10,890,139 B2
(45) Date of Patent: Jan. 12, 2021

(54) APPARATUS AND METHOD OF WASTE ENERGY RECOVERY FROM A SOURCE OF HEATED FLUID

(71) Applicant: Kirk Ray Davis, Grand Rapids, MN (US)

(72) Inventor: Kirk Ray Davis, Grand Rapids, MN (US)

( * ) Notice: Subject to any disclaimer, the term of this patent is extended or adjusted under 35 U.S.C. 154(b) by 277 days.

(21) Appl. No.: 14/859,086

(22) Filed: Sep. 18, 2015

(65) Prior Publication Data

US 2016/0084197 A1 Mar. 24, 2016

Related U.S. Application Data

(60) Provisional application No. 62/053,133, filed on Sep. 20, 2014.

(51) Int. Cl.

| | |
|---|---|
| ***F02G 5/00*** | (2006.01) |
| ***F01P 3/20*** | (2006.01) |
| ***F24D 15/00*** | (2006.01) |

(52) U.S. Cl.

CPC ..... *F02G 5/00* (2013.01); *F01P 3/20* (2013.01); *F24D 15/00* (2013.01); *F01P 2025/04* (2013.01); *F01P 2025/08* (2013.01); *F01P 2060/08* (2013.01); *F01P 2060/18* (2013.01); *F24D 2200/26* (2013.01)

(58) Field of Classification Search

USPC ..... 237/12, 12.1

See application file for complete search history.

(56) References Cited

U.S. PATENT DOCUMENTS

| | | | | |
|---|---|---|---|---|
| 3,868,060 | A | 2/1975 | Mitchell | |
| 3,918,637 | A | 11/1975 | Kofink | |
| 4,289,095 | A * | 9/1981 | Scherr | F01M 5/001 123/142.5 E |
| 4,300,720 | A | 11/1981 | Baier et al. | |
| 4,398,081 | A | 8/1983 | Moad | |
| 4,874,921 | A | 10/1989 | Gerbig, Jr. | |
| 5,165,127 | A * | 11/1992 | Nicholson | A47G 9/0215 165/46 |

(Continued)

FOREIGN PATENT DOCUMENTS

| | | | |
|---|---|---|---|
| JP | 2006322407 | A | 11/2006 |
| JP | 2009068475 | A | 4/2009 |
| WO | 2012174380 | A2 | 12/2012 |

OTHER PUBLICATIONS

International Search Report and Written Opinion dated Dec. 18, 2015, for corresponding International Patent Application No. PCT/US2015/051064, filed Sep. 18, 2015.

*Primary Examiner* — Steven B McAllister
*Assistant Examiner* — John E Bargero
(74) *Attorney, Agent, or Firm* — Steven M. Koehler; Westman, Champlin & Koehler, P.A.

(57) ABSTRACT

A system and method of recovering waste heat from an engine when the engine is not operating, which includes connecting a heater core to source of fluid heated due to operation of the engine with fluid lines, the flow of fluid from the source of heated fluid controlled by one or more pump, and operating the pumps when the engine is not operating to circulate the fluid from the source of heated fluid through the heater core. A second aspect includes a portable heat recovery system.

33 Claims, 7 Drawing Sheets

(56) References Cited

U.S. PATENT DOCUMENTS

| | | | | |
|---|---|---|---|---|
| 5,299,329 | A * | 4/1994 | Constantini | A47K 3/325 4/597 |
| 5,441,099 | A | 8/1995 | Yasso | |
| 7,614,368 | B2 | 11/2009 | Gehres et al. | |
| 7,793,856 | B2 | 9/2010 | Hernandez et al. | |
| 2001/0023669 | A1 | 9/2001 | Buysse | |
| 2004/0187506 | A1 * | 9/2004 | Iwanami | B60H 1/3222 62/236 |
| 2011/0297659 | A1 | 12/2011 | Bixler et al. | |
| 2013/0118746 | A1 * | 5/2013 | Delp | E21B 36/006 166/302 |
| 2013/0192271 | A1 * | 8/2013 | Barnhart | F25B 21/04 62/3.3 |
| 2014/0084025 | A1 * | 3/2014 | Tix | F04B 17/03 222/135 |

* cited by examiner

APPARATUS AND METHOD OF WASTE ENERGY RECOVERY FROM A SOURCE OF HEATED FLUID

CROSS-REFERENCE TO RELATED APPLICATION

The present application claims the benefit of and priority to U.S. provisional patent application Ser. No. 62/053,133, filed Sep. 20, 2014, the content of which is hereby incorporated by reference in its entirety.

BACKGROUND

Liquid-cooled cooling systems for internal combustion engines to maintain the required temperature of the engine are well-known. The cooling system includes a radiator fluidly coupled to a pump, typically driven by the engine, the pump being fluidly connected to the engine block. Heated fluid from the engine block is circulated through the radiator by the pump. When the vehicle is stationary or traveling slowly such that sufficient air does not flow through the radiator, a fan driven by the engine or by an electric motor draws air through the radiator to transfer heat from the radiator to the air. It is also well known to provide a heater in the vehicle that generates heat for the vehicle compartment using the heated fluid from the engine block. Functionally, the heater is similar to that of the radiator described above in that a heater core is fluidly connected to the engine block or radiator. In many designs, the water pump used to provide flow through the engine block and the radiator is also used as a source of pressure to move coolant through the heater core as well. A fan is commonly provided to draw air through the heater core in order to heat the vehicle compartment.

In addition to the heater core described above to heat the vehicle compartment, other heating systems have been incorporated on vehicles to heat other portions of the vehicle using the heated fluid such as other portions of the vehicle compartment if the vehicle compartment is quite large, for example, in a camper or in an emergency vehicle like an ambulance.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A first aspect of the disclosure is a system for recovering waste heat including an engine and a heater core connected to a source of fluid heated due to operation of the engine with fluid lines. One or more pumps connected to the heater core control fluid flow to the heater core. A control device connected to the one or more pumps is configured to operate the one or more pumps when the engine is not operating to circulate the fluid from the source of heated fluid through the heater core.

A second aspect of the disclosure is a portable heat recovery system having a heater core with a first pair of fluid coupling ends fluidly coupled to the heater core to circulate fluid therethrough and retain fluid therein when the first pair of fluid coupling ends are connected to complementary ends. A cabling assembly is provided and includes a pair of fluid lines having first and second ends. A second pair of fluid coupling ends are connected to the first ends of the pair of fluid lines and configured to form a quick disconnect fluid transfer coupling with the first pair of fluid coupling ends. A third pair of fluid coupling ends are connected to the second ends of the pair of fluid lines and configured to form a quick disconnect fluid transfer coupling, wherein the second pair of coupling ends and the third pair coupling ends are configured to retain fluid in the lines when the second pair coupling ends and the third pair of coupling ends are disconnected from complementary ends.

One or more of the following features can be combined with the system and/or portable heat recovery system as desired. The source of fluid can comprise a coolant system of the engine or a separate fluid, for example, liquid isolated from the coolant system of the engine. The separate fluid. The portable heat recovery system can include one or more pumps, while either the portable heat recovery system or the system generally can further include a coupling assembly having a second pair of fluid lines configured to be connected to the source of heated fluid, and a fourth pair of fluid coupling ends fluidly connected to the first pair of fluid lines and removably connected to the third pair of fluid coupling ends. The coupling assembly can further comprise a housing wherein the one or more fluid pumps and/or the fourth pair of fluid coupling ends are mounted in or to the housing. One or more of the pumps can also be disposed in close proximity to the heater core, for example, disposed in an enclosure therefor.

The cabling assembly can house the fluid lines to the heater core and can be flexible and/or rigid as desired. An exterior sheath having an insulating material and/or a cut or wear resistant material can protect the fluid lines and electrical conductors, if provided, therein. The length of the cabling assembly can be so selected so as to be easily carried as a single unit. If desired, the cabling assembly can be formed from multiple, connected cabling segments allowing the length of the cabling assembly to be extended when necessary. Each cabling segment can be configured with identical ends allowing the cabling segments to be connected to one another or to the coupling assembly and/or the heater core.

The heater core can be disposed in an enclosure comprising for example a box having rigid walls or a blanket having flexible sheets form the walls of the enclosure. If desired, the enclosure can include apertures for airflow therethrough. A blower can be mounted in the enclosure and configured to blow air through the apertures and an electrical connector is connected to the blower.

Various forms of control devices can be provided to control the one or more pumps and/or the blower. The control devices can comprise switches, for example but not limited to, mounted to the enclosure. In another embodiment, the control device comprises a controller again that can be mounted in or to the enclosure or separately therefrom. The control device can receive an input from a temperature sensor operably connected to the fluid flowing through the heater core and/or a pressure sensor measuring pressure of the fluid, wherein the control device is configured to provide outputs indicative of temperature and/or pressure of the fluid. The control device can have one or more outputs to control operation of the one or more fluid pumps, valves that can stop fluid flow and/or start and stop the engine based on the temperature and/or pressure of the fluid.

As indicated above, the heater core can be portable, but also can be fixed or secured to a structure such as a building or another portion of a vehicle (or a trailer connected thereto) to be carried therewith. In addition to providing heat to heat an enclosure or object, if desired, a cooling assembly such as adsorption cooler assembly can be operatively coupled to the heater core to use the heat therefrom to cool an enclosure or object.

Another aspect is a method of recovering waste heat from an engine when the engine is not operating. The method includes connecting a heater core to source of fluid heated due to operation of the engine with fluid lines, the flow of fluid from the source of heated fluid controlled by one or more pumps, and operating the pumps when the engine is not operating to circulate the fluid from the source of heated fluid through the heater core. Any of the features described above can be included in the method in other embodiments.

DETAILED DESCRIPTION OF ILLUSTRATIVE EMBODIMENT

Figure 1:
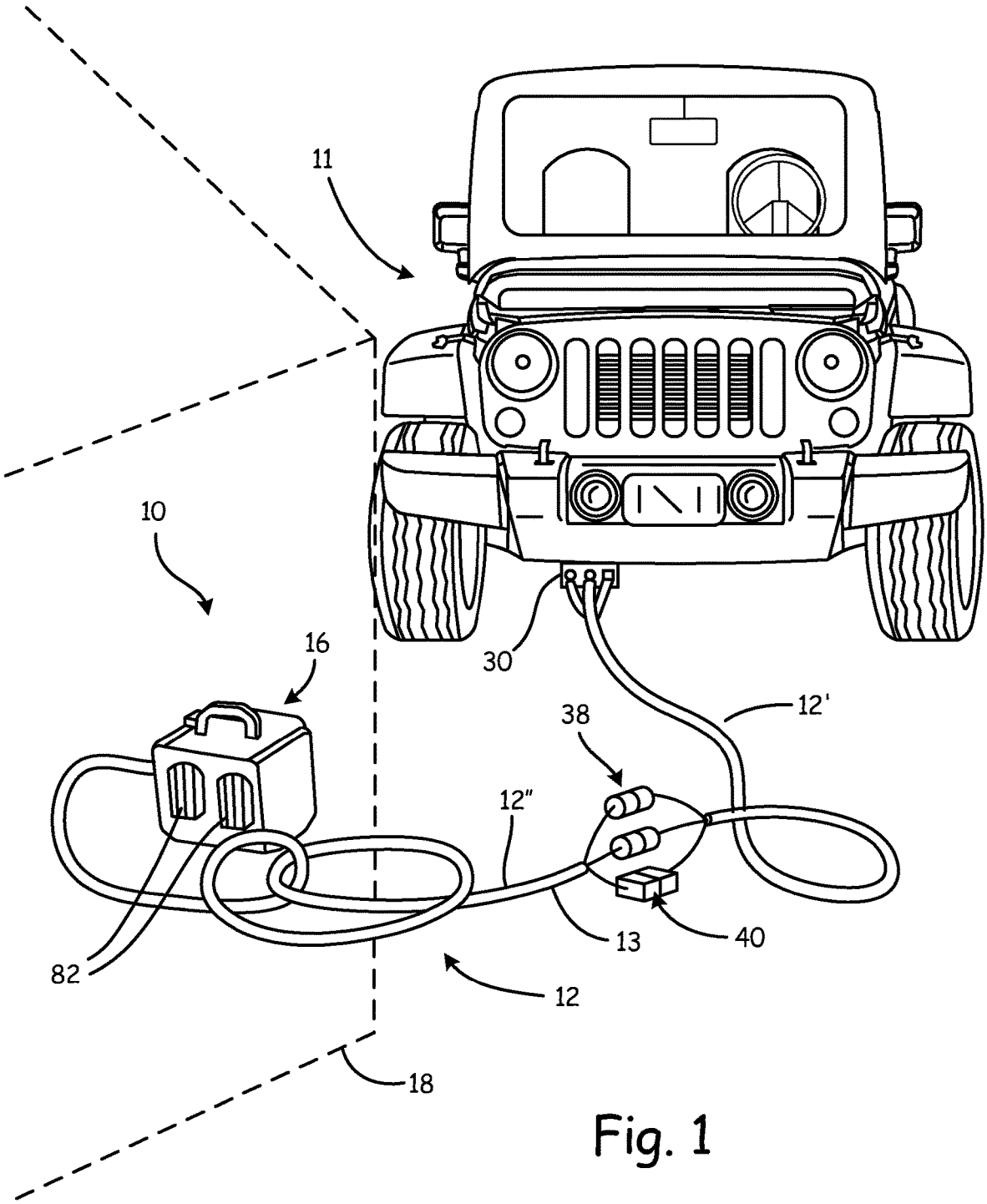
FIG. 1 is an exemplary embodiment of a waste heat recovery system.

FIG. 1 illustrates a portable waste heat recovery system 10 that can be selectively fluidly connected to a heated fluid source such as a cooling system of any liquid cooled engine or other device or machine having heated fluid. In the exemplary and particularly advantageous embodiment, the heated fluid source is a vehicle 11 having an internal combustion engine. Although described for use with the vehicle 11, this should not be considered limiting, but rather representative of a heated fluid source. The portable system 10 can be selectively fluidly connected to the cooling system of the vehicle 11, and in a particularly advantageous embodiment through a cabling assembly 12, preferably flexible for ease of carrying, that allows the system 10 to provide heat at a location quite remote from the vehicle 11 such as but not limited to 15-50 feet from the vehicle 11 using a heater 16. When not in use, the system 10 can be stored in an area or volume that is quite small due to the compact nature of the heater 16 and the cabling assembly 12. Due to the fact that the system 10 can provide large quantities of heat at a long distance from the vehicle 11, the vehicle 11 can then be located at a safe distance away from a the structure or area to be heated so that exhaust fumes from the vehicle 11 when the engine is running are less likely to be present in the structure or area to be heated. For instance, the system 10 can be deployed in an ice fishing house or garage 18, schematically illustrated by dashed lines, in order to heat the interior of the ice fishing house or garage 18 while the vehicle 11 remains outside.

Figure 2:
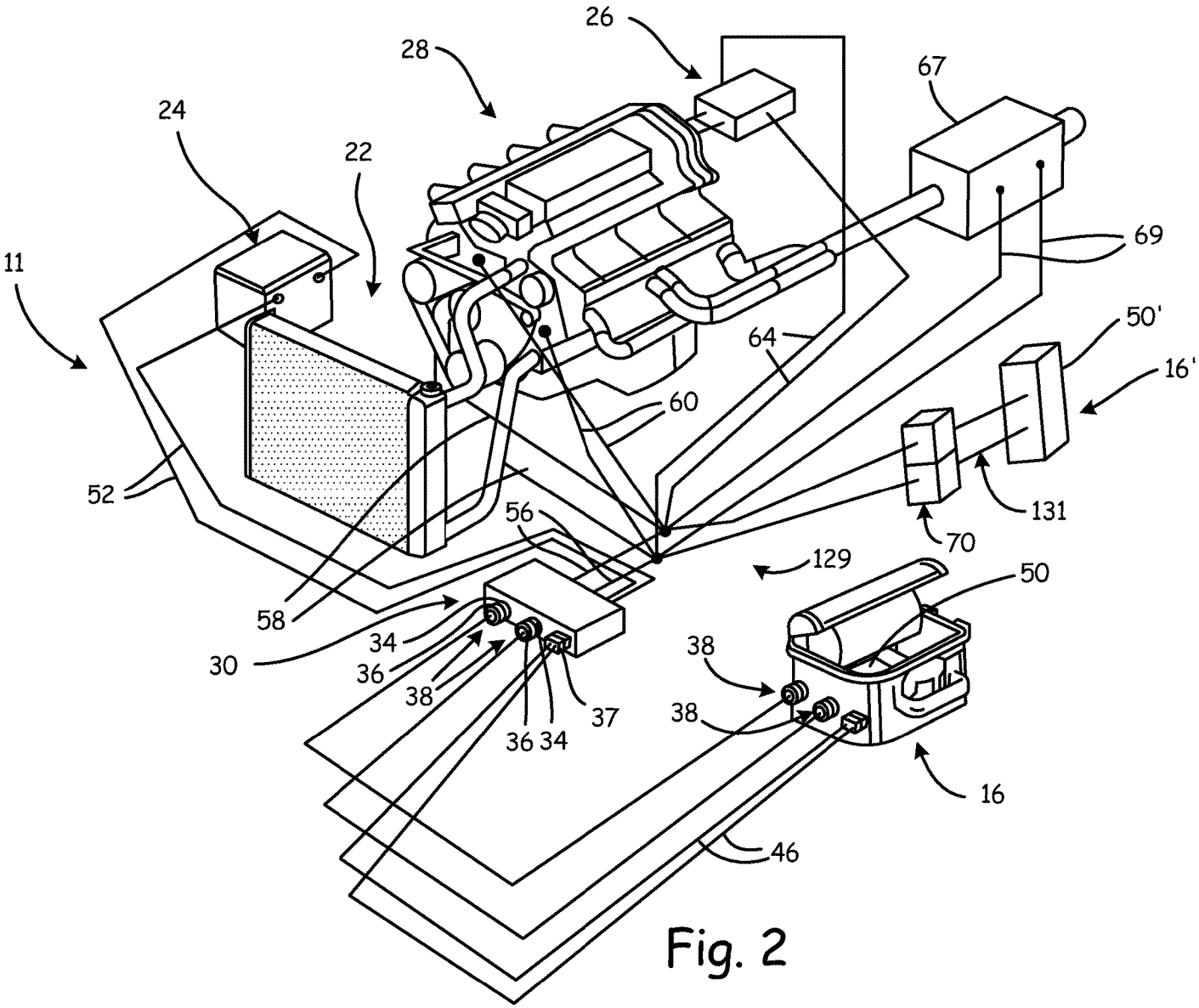
FIG. 2 is a schematic illustration of the waste heat recovery system.

FIG. 2 is a schematic illustration of the system 10 as connected to the vehicle 11 represented in FIG. 2 only by an engine 20, radiator 22, battery 24 and heater core 26. The system 10 further includes a coupling assembly 30, typically mounted to the vehicle 11 to travel with the vehicle 11. The coupling assembly 30 includes quick disconnect couplers 38 having coupling ends 34 that mate with complementary coupling ends 36 provided on the cabling assembly 12 to provide a quick disconnection capability. Such quick disconnect couplers 38 are well known. An electrical power connector 37 from the vehicle 11 to the heater 16 is also provided so as to provide an electrical connection through the cabling assembly 12 for power and/or other electrical signals provided to and/or obtained from heater 16. Quick disconnect couplers 38, which can be the same or similar to couplers having ends 34, 36 are used between the cabling assembly 12 and the heater 16 in addition to an electrical connector 40 so that the cabling assembly 12 can be both disconnected from the heater 16 as well as the coupling assembly 30. In this manner, the cabling assembly 12 and the heater 16 can be carried and stored separately, and preferably with fluid lines 46 used to provide coolant from the vehicle 11 to the heater 16 that remain filled with coolant after disconnection of the fluid lines 46 from both the coupling assembly 30 and the heater 16. In this manner, introduction of air into the cooling system of the engine is prevented, or at least minimized.

A heater core 50 (FIGS. 4 and 5) is also provided in the heater 16 and retains fluid therein when the fluid lines 46 cabling assembly 12 are disconnected, again, to prevent or at least minimize introduction of air into the cooling system. The quick disconnection couplers 38 provided between the cabling assembly 12 and the heater 16 are particularly advantageous in view that the cabling assembly 12 has fluid contained therein, which adds to the weight of the cabling assembly 12 and if quick disconnect couplers were not provided and the lines 46 were to remain fixedly connected to the heater 16, mishandling of the cabling assembly 12 could cause damage to the fluid connections to the heater 16.

In one embodiment, the cabling assembly 12 can include a flexible protective sheath 13 that is heat, wear and/or cut resistance. The sheath 13 conveniently retains all of the coolant and electrical lines between the coupling assembly 30 and the heater 16 so as to be carried a single unit and provide protection as well as convenient handling. At this point it should be noted that if desired, the cabling assembly 12 extending between the coupling assembly 30 and the heater 16 can be formed from a plurality of cabling segments connected together (illustrated schematically in FIG. 1 as cabling segments 12' and 12") with preferably quick disconnect couplers 38 and electrical connector 40 as described above and suitable electrical connectors. In this manner, the overall length of the cabling assembly 12 can be extended as long as desired, limited practically by the acceptable heat loss that may occur due to the length of the cabling assembly 12 in the operating environment. In one embodiment, one or more of cabling segments 12', 12" etc. would each be of length such that the weight of the cabling segment is of convenient weight to be hand carried such as but not limited to 15 to 40 pounds. However, it should be noted in another embodiment, the cabling assembly 12 and/or cabling segments 12', 12" can be carried by and deployed using a reel assembly, not shown.

As indicated above, the coupling assembly 30 provides electrical power to the heater 16. Electrical connection of the coupling assembly 30 to the vehicle 11 is represented schematically in FIG. 2 by lines 52 forming a direct connection to the battery 24. Although such a connection could be used, a suitable connection to any portion of the electrical system of the vehicle 11 should be understood. Likewise, although not illustrated, the electrical connection can be protected with a fuse or breaker mounted in the vehicle 11, the coupling assembly 30, and/or the heater 16.

Coolant lines 56 connect the coupling assembly 30 to the cooling system of the vehicle 11. Such a connection can be at any convenient location on the vehicle 11. In the embodiment illustrated in FIG. 2, the lines 56 can be connected to the radiator hose as represented by lines 58, directly to portions or fixtures on the engine 20 as represented by lines 60 and/or to the lines providing coolant to the vehicle heater core 26 as represented by lines 64, or combinations thereof as desired.

At this point it should be noted that the heated fluid source of a vehicle is not limited to the cooling system, but can be a heat exchanger 67 that extracts waste heat from the exhaust system of the engine. Commonly, fluid lines 69 of the heat exchanger 67 are directly connected to or are fluid lines 59 since the heat exchanger 67 is typically an isolated or independent of the cooling system. Again, other forms of heated fluid sources can be used other than the exemplary embodiments described herein.

Figure 3:
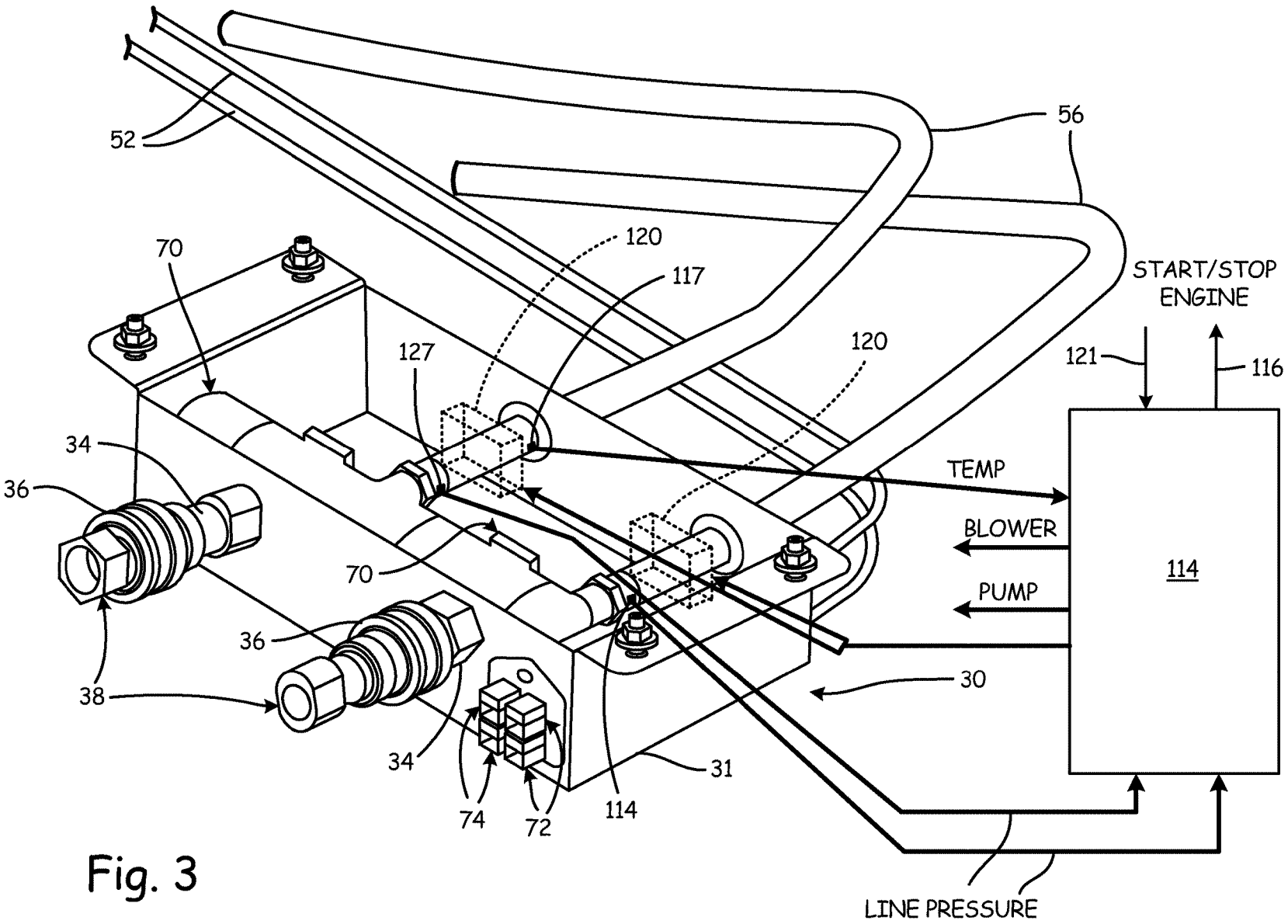
FIG. 3 is a perspective view of a coupling assembly.

Referring to the enlarged illustration of the coupling assembly 30 in FIG. 3, the coupling assembly 30 includes a housing 31 configured to be mounted to the vehicle 11. Circulating pump(s) 70 are mounted to the housing 31 and are fluidly connected and disposed between the quick disconnect couplers 38 provided on the coupling assembly 30 and the coolant lines 56. The circulating pump(s) 70 can be a single speed or a variable speed motor. Electrical connectors 72 are provided on the coupling assembly 30 that connect to the electrical wires 57 provided in the cabling assembly 12 to allow control of pump(s) 70 from the heater 16. Connectors 72 are used to provide power and/or other electrical signals to the heater 16. It should be noted the pump(s) 70 are different than the water pump of the engine that circulates coolant throughout the engine and to a radiator connected thereto. The pump(s) 70 exclusively or directly control fluid flow from the source of heated fluid to the heater core 50, wherein if the source of heated fluid is the coolant heated by the engine, the pump(s) 70 and not the water pump of the engine 20 control fluid flow to the heater core 50. As explained below, the pump(s) 70 operate when the engine 20 is in many instances not running.

Figure 4:
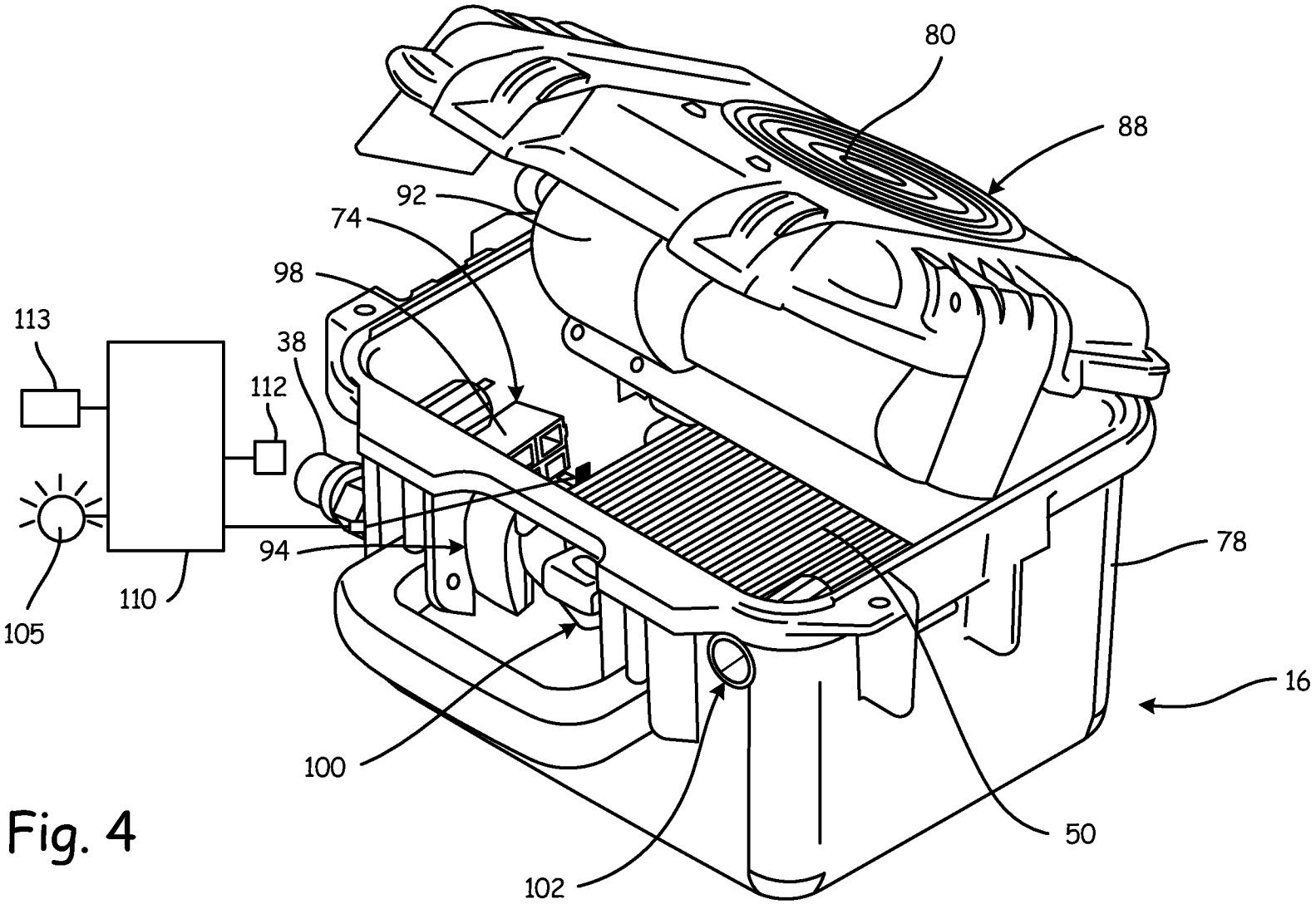
FIG. 4 is a perspective view of a portable heat recovery system.
Figure 5:
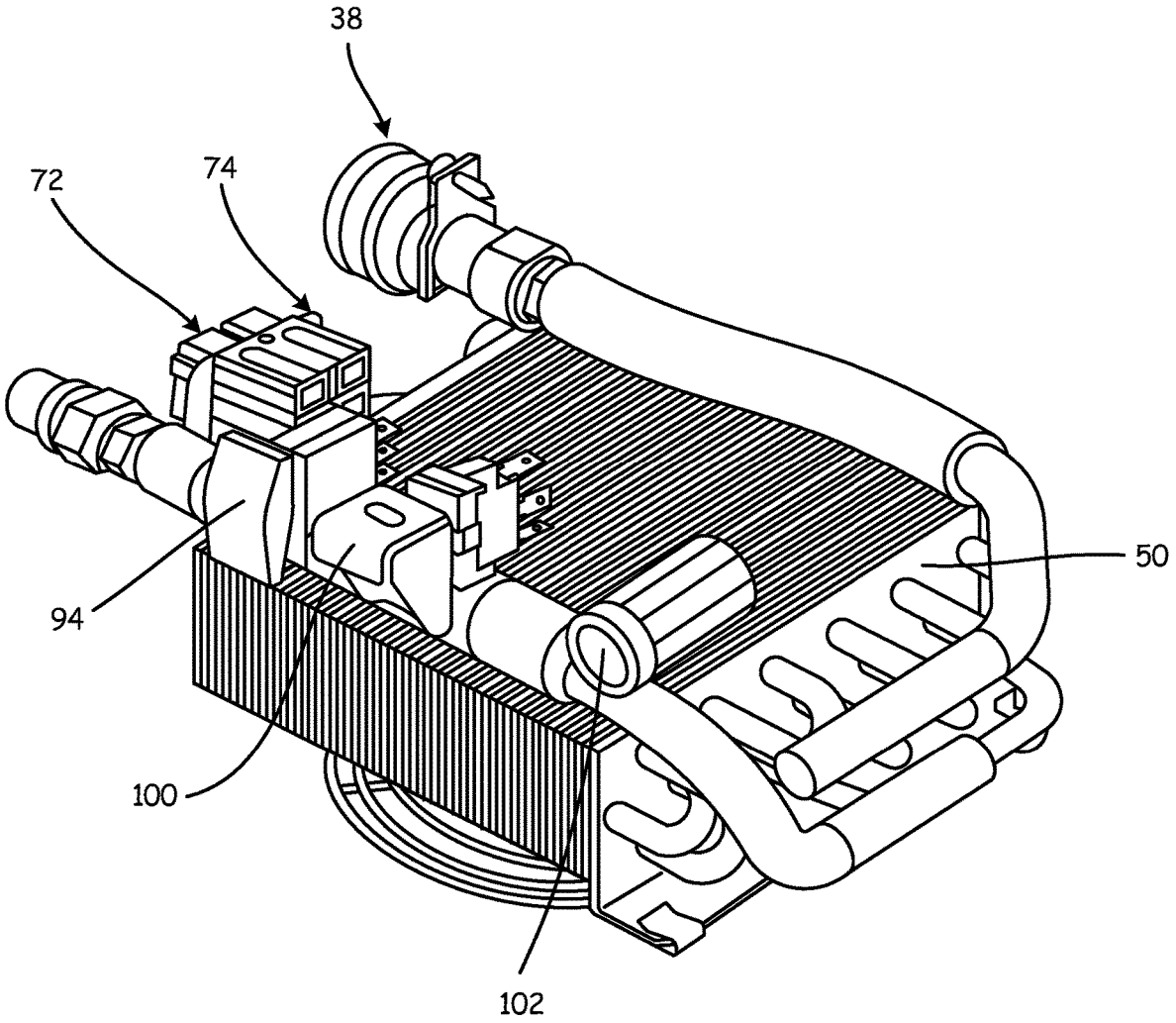
FIG. 5 is a perspective view of the portable heat recovery system with portions removed.

FIGS. 4 and 5 provide an enlarged view of the heater 16 and components mounted therein, respectively. Generally, in one embodiment, a rugged enclosure 78 such as manufactured by Pelican Products, Inc. of Tempe, Ariz. or Seahorse Protective Equipment Cases of La Verne, Calif. houses the components of the heater 16 and includes apertures 80 and 82 (FIG. 1) to allow airflow through the enclosure 78. In the embodiment illustrated, at least one aperture 80 is provided on a lid 88 while at least one aperture 82 is provided on the side of the enclosure 78 opposite the first aperture 80; however, it should be understood that this is but one embodiment. A handle 81 (FIG. 1) allows the heater 16 to be easily carried, although or other recesses configured to enable the heater 16 to be carried can be used and are equivalent to the handle 81.

The heater core 50 and a blower 92 are mounted in the enclosure 68, and in the embodiment illustrated, the blower 92 is mounted to the lid 88 to be in fluid communication with aperture 80, while the heater core 50 is mounted to an inner surface of the enclosure 68 proximate the aperture 82. An electrical switch 94 selectively provides power from the electrical connector 74 to the blower 92 which can include a single speed, multi-speed or variable speed electric motor. The connectors 72 of the coupling assembly 30 connect wires provided in the cable assembly 12 that in turn are connected to connector 98, which are connected to electrical switch 100. Electrical switch 100 allows the pump(s) 70 to be remotely turned off at the heater 16 if desired. A cigarette lighter receptacle 102 can be provided if desired so that electrical devices such as but not limited to lights, entertainment equipment, power converters, can be powered remotely from the vehicle 11 using the electrical power available on the vehicle 11.

It has been found that significant efficiency of the system 10 is obtained with controlled flow of coolant from the vehicle 11 and through the heater core 50. Without specific control such as if the coolant lines 56 are fluidly connected to the cooling system of the vehicle 11 and the water pump of the engine 20 is used to move coolant through the heater 16, the amount of heat generated remotely is very low. Instead, pump(s) 70 control fluid flow through the heater 16. It has been discovered that fluid flow of 3-12 gallons per minute, and more preferably 5-9 gallons per minute, and yet more preferably 6-8 gallons per minute is particularly advantageous because the heater 16 can be used with a wide variety of engine sizes for example, from, for example, 500 cc or less through engines typically found in vehicles such as 1.4 liter to 8.3 liters and even larger engines. In addition, it has been discovered that a flow rate of 6-8 gallons per minute, and in particular, a fluid flow of about 7 gallons per minute has been found to be optimal even when different heaters that vary in output, for example, a 20,000 BTU output, 40,000 BTU output and 80,000 BTU output are connected to the coupling assembly 30. In each of these versions, the same enclosure 68 can be used with different heater cores 50 mounted in the enclosure 68. In operation, the pre-charged coolant lines (i.e. filled with coolant) and the electrical lines of the cable assembly 12 are connected both to the coupling assembly 30 and to the heater 16. The switch 94 on the enclosure 68 when operated activates the blower 92 to move air through the heater core 50. Switch 100 is operated to power the pump(s) 70 to supply the heater core 50 with coolant from the vehicle 11, which, for example, typically varies from 125 to 225 degrees. At 7 gallons per minute and 150 degree coolant supply from the vehicle, the heater 16 using an insulated cable assembly 12 of 25-50 feet can deliver approximately 135 degrees of hot air in an environment having an ambient air temperature of 10 degrees.

In further embodiment, a thermostat controlled circuit represented at 110 but suitably mounted in the enclosure 68 can be operably connected to the blower 92 and/or the pump(s) 70. The thermostat controlled circuit 110 includes a user operated input device such as but not limited to a rotatable knob 105 having a scale indicating a desired temperature. A temperature sensor 112, for example, mounted to the enclosure 78 measures the ambient temperature in the structure. A digital readout device 113 can be included in circuit 110 and mounted to enclosure 68 to indicate the current ambient temperature. In another embodiment, setting of the desired ambient temperature can be digitally displayed and adjusted with suitable user operated buttons or switches connected to circuit 110.

In many instances, the coolant temperature from the vehicle 11 will be sufficient to operate the heater 16 for at least some period of time without the vehicle 11 running. A control circuit represented at 114 in FIG. 3 can be suitably mounted in the housing of coupling assembly 30 (or in enclosure 68) and receives as an input, the temperature of the coolant, for example, as measured at the coupling assembly 30 by temperature sensor 117. When the coolant temperature falls below a selected temperature, the control circuit 114 can provide an output command represented at 116 to start the vehicle 11. Devices for allowing remote starting of the vehicle 11 are well known and are not pertinent to the present invention, thus, will not be further discussed. Once the coolant temperature reaches a higher second selected temperature, possibly after a selected time period of engine 20 operation, the control circuit 114 can provide an output command to shut the engine 20 off.

Depending on the heating capabilities of the heater 16, and the coolant capacity of the cooling system of the vehicle 11, which commonly is based on the size of the engine, the heater 16 could potentially remove too much heat from the cooling system thereby lowering the coolant temperature, and thus the engine below a desired operating temperature of the engine manufacturer. As indicated above, the control circuit 114 can monitor the coolant temperature. If the coolant temperature falls below a selected temperature with the engine 20 running, it may be indicative of the heater 16 removing too much heat from the cooling system. In such a case, the control circuit 114 can control operation of the blower 92 and/or the pump(s) 70 to control the amount of heat withdrawn from the heater core 50 or the amount of coolant provided to the heater 16, respectively. The control circuit 114 can be configured to take one or more of the following actions which include: turning off the pump(s) 70 and/or the blower 92, or reducing the speed thereof until the temperature of the coolant rises to a selected temperature. The control circuit 114 can also be configured to intermittently operate either the pump(s) 70 and/or the blower 92. The control circuit 114 can also be configured if desired to inhibit coolant flow to the heater 16 by turning off the pumps 70 or operating valve(s) 120 fluidly connected so as to selectively inhibit fluid flow. The valves 120 shown schematically can be controlled electrically such as through a solenoid operated valve. It should be noted that the control circuit 114 receives an input signal 121 from the engine, vehicle or a sensor indicative of whether the engine is running. For example, a sensor that detects whether a component of the engine is rotating via a proximity sensor can be used. In another embodiment, the sensor can be an audio sensor to sense when the engine is running.

In a further embodiment, pressure sensors schematically illustrated at 127 can be provided to measure the pressure in one or both of the fluid lines connecting the coupling assembly 30 to the heater 16. The signals indicative of the measured pressure are provided to the control circuit 114. The control circuit 114 can shut off the pump(s) 70 and/or operate the valves 120 to inhibit fluid flow through the system if the pressure falls below a selected threshold, which could indicate that there exists a coolant leak in the system between or in the coupling assembly 30 and the heater 16.

It should be noted that aspects of the waste heat recovery system 10 are not limited to only portable applications. Rather, as illustrated in FIG. 2 components of the system 10 can be utilized in other applications. For example, a heater 16' and in particular a heater core 50' can be fluidly coupled to the source of heated fluid without quick disconnect couplings such as the case where the heater core 50' may be fluidly coupled to a stationary engine with the heater core 50' fixedly mounted or otherwise disposed in the stationary structure 18 schematically illustrated in FIG. 1. In such an application fluid lines connecting the heater core 50 to the pump(s) 70 and the fluid lines 129 from the pump(s) 70 to the engine 20 and fluid lines 131 from the pump(s) to the heater core 50' may be rigid rather than disposed in a flexible cabling assembly 12 with or without electrical conductors providing power to the blower 92 or other electrical components associated with the heater core 50'. The control circuit 114, other control devices like switches or the like (not shown in FIG. 2), can be located as desired, for example on an inner wall of the structure 18.

In another application also illustrated by the schematic drawing of FIG. 2, the heater core 50' can be mounted in another portion of the vehicle having the engine 20, or mounted in a trailer or the like pulled by the vehicle having the engine 20 such as the case in a tractor trailer application. In the latter application, the coupling assembly 30 can be mounted to the tractor, while the flexible cabling assembly 12 couples the heater core 50 to the components mounted to the tractor. The control circuit 114 can be, for example, located in the trailer with the heater core 50, disposed in the tractor or integrated as part of the control system of the tractor.

Figure 7:
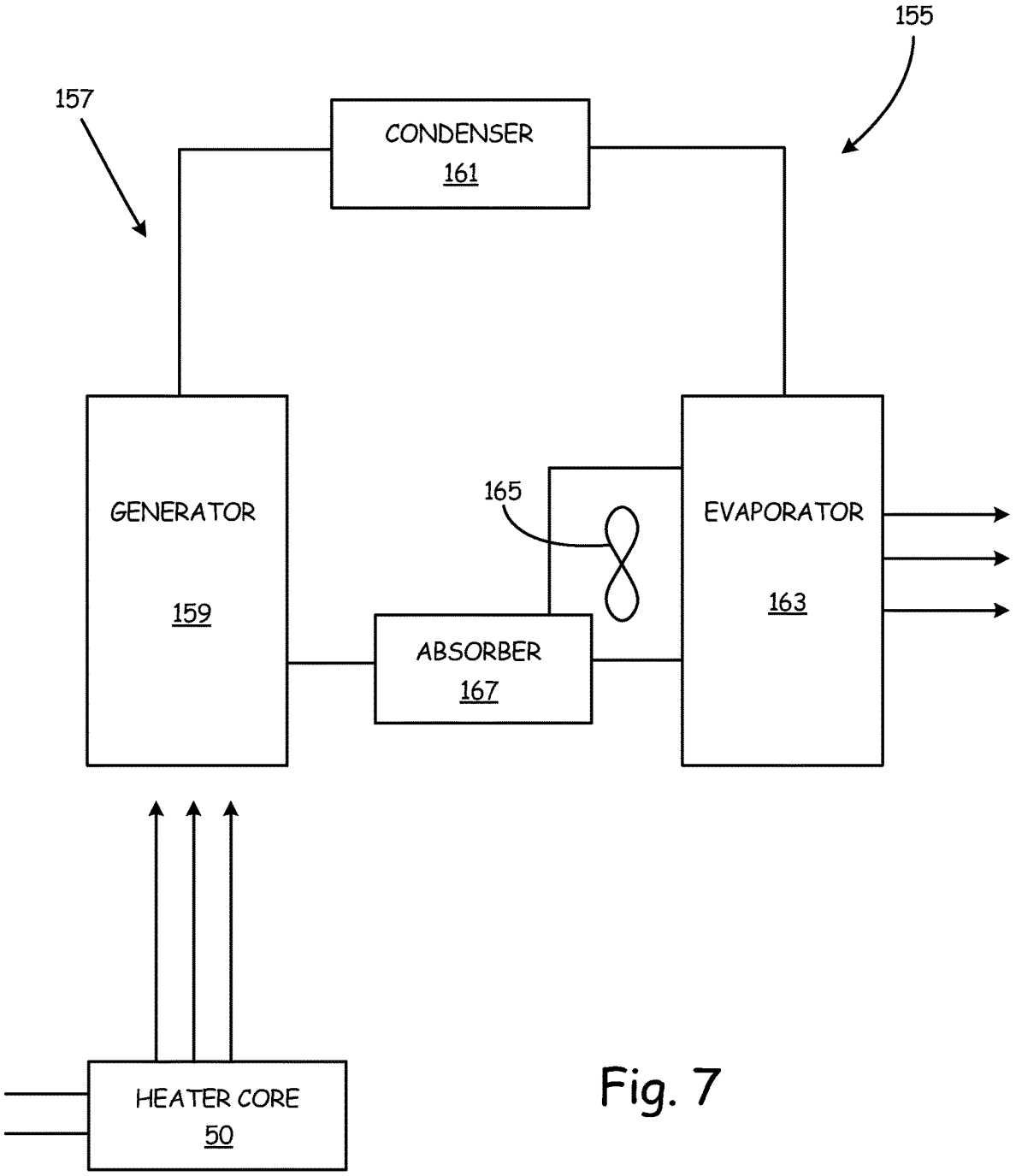
FIG. 7 is a schematic representation of a cooling unit.

Although in operation the heater core 50 provides heat to a selected location remote from the source of heated fluid such as the coolant system of the engine 20, it should be noted providing heat to increase or maintain the temperature of a structure 18 or other portion of a vehicle or trailer connected thereto need not be its sole function. Referring to FIG. 7, the heater core 50 can be used to provide cooling such as provided by an air conditioning or refrigeration unit schematically represented at 155. Generally, the heater core 150 provides heat that can be used by a cooling assembly 157 such as an absorption cooling assembly herein illustrated by way of example. The heater core 50 and cooling assembly 157 can be disposed in a portable enclosure movable due to the flexibility of the cabling assembly 12 or be mounted in a fixed location on the vehicle or other structure. Components and operation of an air conditioning or refrigeration unit utilizing an absorption cooling assembly are well known and are only briefly described herein since the specific components and operation are not necessary for understanding application of aspects of the present invention to this application.

Generally, the cooling or refrigeration process starts with a generator 159 having a liquid by way of example water containing dissolved ammonia (or other form of liquid including water, salt water, propane, water-lithium bromide, etc.). The heater core 50 heats the generator 159 until it reaches the boiling point of ammonia. Since ammonia boils at a lower temperature than water does, the ammonia leaves the generator 159 and moves into a condenser 161. In the condenser 161, the ammonia starts to cool and eventually forms liquid ammonia. The ammonia flows down from the condenser 161 into a hydrogen-filled chamber or evaporator 163. In the low-pressure chamber of the evaporator 163, the ammonia expands, cooling rapidly as it does. A fan or blower 165 blows on the evaporator 163, cooling down the air as it blows past. The cold air is circulated through to the location to be cooled. An absorber 167 provides water through the evaporator 163. Ammonia dissolves easily in water, but hydrogen does not. The water with the dissolved ammonia flows back to the generator, starting the cycle all over again. In addition to cooling, the heater core 50 can also be operated if desired to provide heat to the location rather than cooling through use of the cooling assembly 157.

Figure 6:
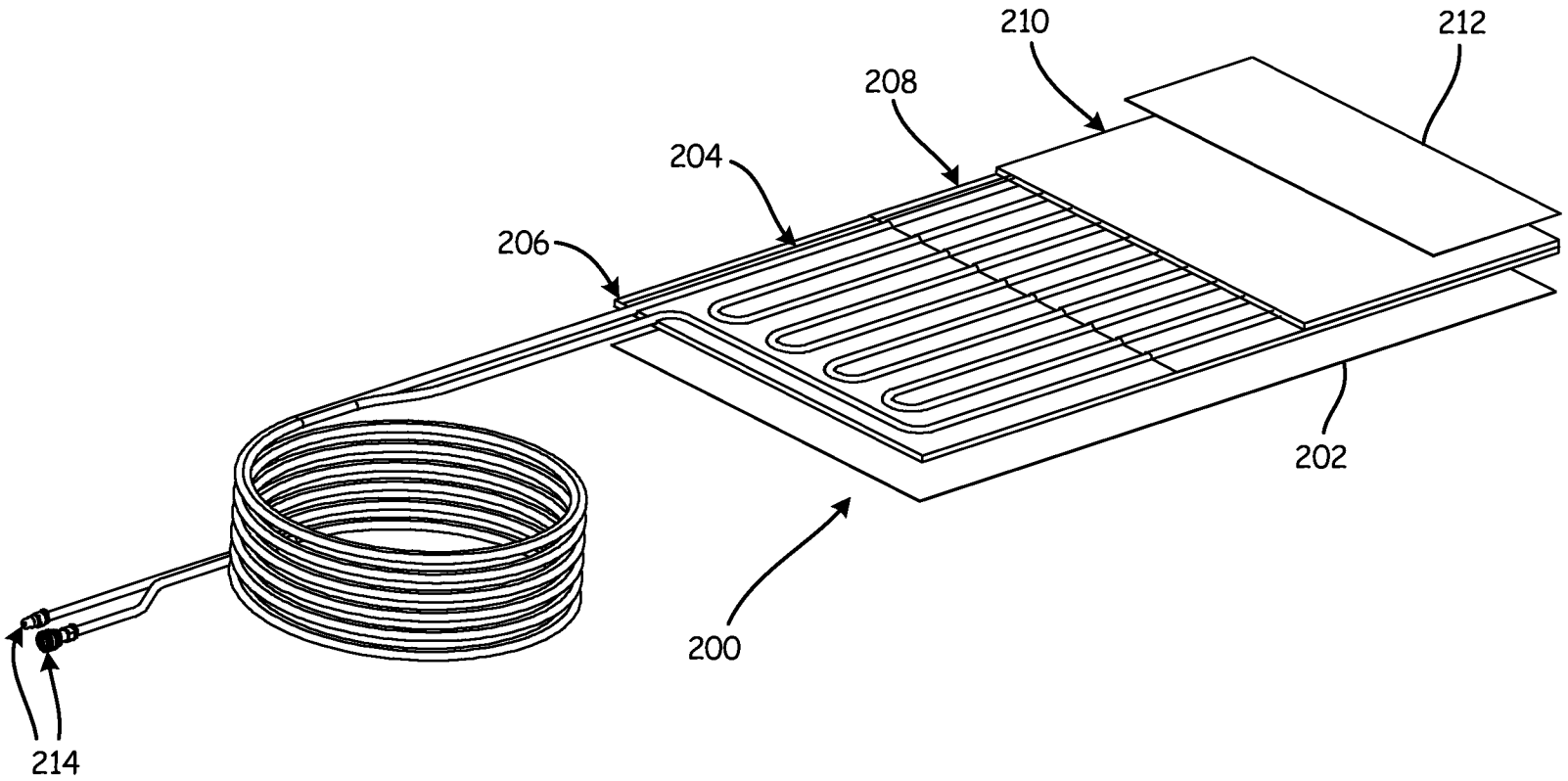
FIG. 6 is a schematic representation of a heating blanket.

In another embodiment illustrated in FIG. 6, the system can comprise an insulated heating blanket 200 that is convenient for example and without limitation to melt snow, thaw a selected area of the ground and/or be used as an aid in curing concrete. The blanket 200 can be of a multi-layered enclosure, preferably flexible, having a conductive outer layer 202 for conducting heat from a heater core comprising a hose 204 to the surface to be heated. A suitable conductive layer for example can comprise silver cross woven polyethylene 202. A flexible layer 206 can be provided to help support the hose 204 with portions typically spaced apart and distributed throughout the blanket 200 and maintain the portion in positions so as not to bunch up. The flexible layer 206 can be a heat conductive or a light insulating layer. A high-density bubble layer may be used as layer 206. A heat reflective layer 208 directs heat from hose downwardly toward layer 202. The heat reflectively layer 208 can be, for example, made of aluminum. A high insulating layer 210 on a side of the reflective layer 208 opposite layer 202 helps minimize heat loss upwardly and can for example be a high-density closed cell foam layer. An outer protective layer 212 is provided and secured for example to outer layer 202. A suitable material for outer protective layer 212 can comprise cross woven polyethylene, which can be of a dark color such as black. Quick disconnect couplers 214 identical to those used on the heater 16 can be provided so as to allow the cabling assembly 12 to be used with the heating blanket 200. Like the heater 16, the disconnect couplers 214 retain coolant in the hose 204 when the couplers are disconnected from the cable assembly 12 (i.e. pre-charged) so as to minimize or prevent air from entering the cooling system of when not in use.

The system components herein described, i.e. the heater 16, the cabling assembly 12, the coupling assembly 30 and heating blanket provide a user a lot of flexibility to heat an area or structure using one or more heated fluid sources. For example, a user can equip two or more heated fluid sources such as two or more vehicles, stationary engines such as used with electrical generators, or the like each with a coupling assembly 30. In this manner, the user can use cable assembly 12 and the heater 16 or heating blanket with any of the heated fluid sources as desired. For example, the user could equip an automobile or truck with one coupling assembly 30 and an all terrain vehicle (ATV) with another coupling assembly 30. The user can then use the same heater or heating blanket with either vehicle. As discussed above, the control circuit 114 can monitor the coolant temperature such that the heat withdrawn from the vehicle does not cause the temperature to fall below the manufactures desired operating range.

In another application, the user can have multiple heaters 16 and/or heating blankets with different output capabilities. In this manner, the user can select a heater 16 or heating blanket that meets the user's situation. For example, if a small structure is to be heated a lower output heater 16 can be used, while if a larger structure must be heated, a heater 16 with higher output capabilities could then be used.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed is:

1. A portable heat recovery system to recovery heat from an internal combustion engine of a vehicle having a cooling system with a water pump for cooling fluid of the internal combustion engine, comprising:

an enclosure having apertures for airflow;

a heater core mounted in the enclosure;

a blower mounted in the enclosure and configured to blow air through the heater core and the apertures;

a first pair of fluid coupling ends fluidly coupled to the heater core to circulate fluid therethrough and retain the cooling fluid therein when not connected to complementary ends;

a cabling assembly including:

a pair of fluid lines having first and second ends;

a second pair of fluid coupling ends connected to the first ends of the pair of fluid lines and configured to form a quick disconnect fluid transfer coupling with the first pair of fluid coupling ends; a third pair of fluid coupling ends connected to the second ends of the pair of fluid lines and configured to form a quick disconnect fluid transfer coupling, wherein the second pair of fluid coupling ends and the third pair of fluid coupling ends are configured to retain the cooling fluid in the pair of fluid lines when the second pair of fluid coupling ends and the third pair of fluid coupling ends are disconnected from each other;

a pair of electrical conductors having first conductor ends at the first ends of the pair of fluid lines and second conductor ends at the second ends of the pair of fluid lines, the first conductor ends electrically connected to the blower;

an exterior sheath securing the pair of fluid lines and electrical conductors therein so as to be carried as a single unit;

one or more fluid pumps configured for mounting to the vehicle to travel therewith, the one or more fluid pumps being separate from the water pump, the one or more fluid pumps fluidly connected to the pair of fluid lines and to the heater core and configured to circulate the cooling fluid therethrough;

a coupling assembly configured for mounting to the vehicle to travel therewith, the coupling assembly including:

a second pair of fluid lines configured to be connected to the cooling system to receive the cooling fluid, the second pair of fluid lines having first cooling system ends configured to be connected to the cooling system to receive the cooling fluid and second cooling system ends opposite the first cooling system ends;

a fourth pair of fluid coupling ends fluidly and removably connected to the third pair of fluid coupling ends; and one or more valves fluidly coupled to the second cooling system ends, the one or more valves being fluidly connected to the fourth pair of fluid coupling ends between the second cooling system ends and the fourth pair of fluid coupling ends, the one or more valves being selectively operable to stop flow of the cooling fluid through the fourth pair of fluid coupling ends;

a temperature sensor operably connected to the cooling fluid flowing through the heater core and configured to provide an output indicative of temperature of the cooling fluid;

a housing mountable to the vehicle to travel with the vehicle; and a control device disposed in the housing and operably connected to the one or more valves and configured to receive an input indicative of a leak in the flow of the cooling fluid to the heater core and operate the one or more valves to stop the flow of the cooling fluid through the fourth pair of fluid coupling ends based on the input, the control device being connected to the temperature sensor to receive the output indicative of temperature, the control device being configured to operate the one or more fluid pumps based on the output indicative of temperature, and the control device being further configured to operate the one or more fluid pumps when the water pump is not operating to circulate the cooling fluid and control the flow of the cooling fluid from the cooling system through the heater core.

2. The portable heat recovery system of claim 1 wherein the one or more fluid pumps are mounted in the housing.

3. The portable heat recovery system of claim 1 wherein the cabling assembly comprises removably connectable segments, each segment having fluid lines, electrical conductors and connectors to selectively connect the electrical conductors of different segments together, wherein a portion of each connector is proximate each of the ends of the pair of fluid lines in each segment.

4. A system for recovering waste heat, the system comprising an engine configured to create a source of heated fluid;

engine fluid couplings configured to circulate fluid therethrough and retain fluid in the source of heated fluid when not connected to complementary ends;

a heater core mounted in an enclosure;

a first pair of fluid coupling ends fluidly coupled to the heater core to circulate fluid therethrough and retain the fluid therein when not connected to a set of complementary ends;

a cabling assembly including:

a pair of fluid lines having first and second ends;

a second pair of fluid coupling ends connected to the first ends of the pair of fluid lines and configured to form a quick disconnect fluid transfer coupling with the first pair of fluid coupling ends;

a third pair of fluid coupling ends connected to the second ends of the pair of fluid lines and configured to form a quick disconnect fluid transfer coupling with the source fluid coupling ends, wherein the second pair of fluid coupling ends and the third pair of fluid coupling ends are configured to retain the fluid in the pair of fluid lines when the second pair of fluid coupling ends and the third pair of fluid coupling ends are disconnected from each other;

one or more pumps connected to the heater core to control fluid flow to the heater core;

a coupling assembly including:

a second pair of fluid lines configured to be connected to the source of heated fluid to receive the fluid, the second pair of fluid lines having first system ends configured to be connected to the source of heated fluid to receive the fluid and second system ends opposite the first system ends, the source fluid coupling ends being fluidly and removably connected to the third pair of fluid coupling ends; and a fourth pair of fluid coupling ends fluidly and removably connected to the third pair of fluid coupling ends; and one or more valves fluidly coupled to the second system ends, the one or more valves being fluidly connected to the source fluid coupling ends between the second system ends and the source fluid coupling ends, the one or more valves being selectively operable to stop flow of the fluid through the source fluid coupling ends;

a temperature sensor operably connected to the fluid flowing through the heater core and configured to provide an output indicative of temperature of the fluid; and a housing having a control device operably connected to the one or more valves and configured to receive an input indicative of a leak in the flow of the fluid to the heater core and operate the one or more valves to stop the flow of the fluid through the source fluid coupling ends based on the input, the control device being connected to the temperature sensor to receive the output indicative of temperature, the control device being configured to operate the one or more pumps based on the output indicative of temperature, and the control device being further configured to operate the one or more pumps when the engine is not operating to circulate the flow of the fluid from the source of heated fluid through the heater core at a flow rate of 3-12 gallons per minute.

5. The system of claim 4 wherein the enclosure has apertures for airflow therethrough, a blower mounted in the enclosure and configured to blow air through the apertures, and wherein the engine includes a battery and the cabling assembly includes electrical conductors connecting the battery to the blower.

6. The portable heat recovery system of claim 1 wherein the enclosure includes first switch connected to the blower and a second switch electrically connected to the one or more fluid pumps, and wherein the one or more fluid pumps are remote from the enclosure and an electrical conductor is provided in the cabling assembly to electrically connect the second switch to the one or more fluid pumps.

7. The portable heat recovery system of claim 1 wherein the control device includes another output configured to control the engine so as to start and stop the engine generating heated cooling fluid based on the output from the temperature sensor.

8. The portable heat recovery system of claim 1 and further comprising a pressure sensor configured to provide an output indicative of pressure of the cooling fluid in the cabling assembly to the control device.

9. A method of recovering waste heat from an engine of a vehicle that creates a source of heated fluid due to operation of the engine, the engine having a cooling system with a water pump for circulating fluid in the engine when the engine is operating, a battery and engine fluid coupling ends to circulate fluid therethrough and retain fluid in the source of heated fluid when not connected to complementary ends, the method of recovering waste heat occurring when the engine is not operating, the method comprising;

providing a heater assembly comprising:

an enclosure having apertures for airflow;

a heater core mounted in the enclosure;

a blower mounted in the enclosure and configured to blow air through the heater core and the apertures;

a first pair of fluid coupling ends fluidly coupled to the heater core to circulate fluid therethrough and retain fluid therein when not connected to fluid coupling complementary ends;

a cabling assembly including:

a pair of fluid lines having first and second ends;

a second pair of fluid coupling ends connected to the first ends of the pair of fluid lines and configured to form a quick disconnect fluid transfer coupling with the first pair of fluid coupling ends;

a third pair of fluid coupling ends connected to the second ends of the pair of fluid lines and configured to form a quick disconnect fluid transfer coupling, wherein the second pair of fluid coupling ends and the third pair of fluid coupling ends are configured to retain the fluid in the pair of fluid lines when the second pair of fluid coupling ends and the third pair of fluid coupling ends are disconnected from each other;

a pair of electrical conductors having first conductor ends at the first ends of the pair of fluid lines and second conductor ends at the second ends of the pair of fluid lines, the first conductor ends electrically connected to the blower;

an exterior sheath securing the pair of fluid lines and electrical conductors therein so as to be carried a single unit; and a pump, separate from the water pump, fluidly connected to the pair of fluid lines and to the heater core and configured to circulate fluid therethrough;

a coupling assembly including:

a second pair of fluid lines configured to be connected to the source of heated fluid to receive the fluid, the second pair of fluid lines having first system ends configured to be connected to the source of heated fluid to receive the fluid and second system ends opposite the first system ends fluidly coupled to the engine fluid coupling ends, the engine fluid coupling ends being fluidly and removably connected to the third pair of fluid coupling ends; and one or more valves fluidly coupled to the second system ends, the one or more valves being fluidly connected to the engine fluid coupling ends between the second system ends and the engine fluid coupling ends, the one or more valves being selectively operable to stop flow of the fluid through the engine fluid coupling ends;

a temperature sensor operably connected to the fluid flowing through the heater core and configured to provide an output indicative of temperature of the fluid;

a housing having a control device operably connected to the pump, the one or more valves and the temperature sensor;

mounting the pump, the coupling assembly and the housing to the vehicle for travel with the vehicle;

connecting the second pair of fluid coupling ends with the first pair of fluid coupling ends;

connecting the third pair of fluid coupling ends with the engine fluid coupling ends;

connecting the second conductor ends to the battery so as to provide power to the blower;

controlling the one or move valves with the control device based on an input indicative of a leak in the flow of the fluid to the heater core; and controlling the pump with the control device when the engine is not operating to control flow of the fluid from the source of heated fluid through the heater core at a flow rate of 3-12 gallons per minute, wherein controlling includes controlling the pump based on the output indicative of temperature of the fluid from the temperature sensor.

10. The method of claim 9 wherein the heater core receives coolant fluid used to cool the engine during operation, and wherein connecting the second pair of fluid coupling ends with the first pair of fluid coupling ends and connecting the third pair of fluid coupling ends with the engine fluid coupling ends causes direct circulation of fluid from the heater core into the engine.

11. The method of claim 9 wherein the heater core receives fluid from a heat exchanger having fluid that is separate from coolant fluid used to cool the engine during operation, and wherein connecting the second pair of fluid coupling ends with the first pair of fluid coupling ends and connecting the third pair of fluid coupling ends with the engine fluid coupling ends causes direct circulation of fluid between from the heater core into the heat exchanger.

12. The method of claim 9 and further comprising;

measuring a temperature of the fluid provided to or through the heater core; and operating the engine to heat the source of heated fluid when the temperature of the fluid falls below a selected temperature and turning the engine off when the source of heated fluid reaches a selected temperature.

13. The system of claim 4 wherein the enclosure comprises a blanket.

14. The system of claim 4 wherein the source of heated fluid comprises a coolant system of the engine.

15. The system of claim 14 wherein the control device is configured to provide an output configured to control operation of the engine based on the temperature of the fluid.

16. The system of claim 15 wherein the engine is on a vehicle.

17. The system of claim 4 and further comprising a cooling assembly operably coupled to the heater core to receive heat therefrom, the cooling assembly comprising a generator configured to receive the heat and heat cooling fluid, an evaporator connected to the generator to receive heated cooling fluid and cool the cooling fluid to a liquid that is returned to the generator; and a blower configured to blow air on the evaporator.

18. The method of claim 9 and further comprising locating the enclosure in a structure that is remote from the engine and controlling comprises controlling at least one of the pump and the blower to control a temperature in the structure.

19. The method of claim 10 and further comprising selectively turning the engine on based on the temperature of the fluid through the heater core.

20. The method of claim 19 and further comprising selectively turning off the engine based on the temperature of the fluid through the heater core.

21. The method of claim 18 and further providing a cooling assembly operably coupled to the heater core to receive heat therefrom, the cooling assembly comprising a generator configured to receive the heat and heat cooling fluid, an evaporator connected to the generator to receive heated cooling fluid and cool the cooling fluid to a liquid that is returned to the generator; and an evaporator blower configured to blow air on the evaporator, and wherein controlling the temperature in the structure comprises cooling an inside of the structure.

22. The method of claim 18 wherein controlling the temperature in the structure comprises heating an inside of the structure.

23. The portable heat recovery system of claim 1 wherein the one or more valves comprise a first valve fluidly coupled to a first fluid coupling end of the fourth pair of fluid coupling ends and a second valve fluidly coupled to a second fluid coupling end of the fourth pair of fluid coupling ends.

24. The portable heat recovery system of claim 23 wherein the first valve and the second valve are mounted in the housing.

25. The portable heat recovery system of claim 24 wherein the fourth pair of fluid coupling ends are mounted to the housing.

26. A heat recovery system to recovery heat from an internal combustion engine of a vehicle having a cooling system with a water pump for cooling fluid of the internal combustion engine, comprising:

an enclosure having apertures for airflow;

a heater core mounted in the enclosure having a pair of heater core fluid coupling ends;

a blower mounted in the enclosure and configured to blow air through the heater core and the apertures;

a pair of fluid lines having first and second ends, the first ends fluidly coupled to the heater core fluid coupling ends;

electrical conductors electrically connected to the blower;

one or more fluid pumps configured for mounting to the vehicle to travel therewith, the one or more fluid pumps being separate from the water pump, the one or more fluid pumps fluidly connected to the pair of fluid lines and to the heater core and configured to circulate the cooling fluid therethrough;

a coupling assembly configured for mounting to the vehicle to travel therewith, the coupling assembly including:

a second pair of fluid lines configured to be connected to the cooling system to receive the cooling fluid, the second pair of fluid lines having first cooling system ends configured to be connected to the cooling system to receive the cooling fluid and second cooling system ends opposite the first cooling system ends; and one or more valves fluidly coupled between the second cooling system ends and the pair of fluid lines, the one or more valves being selectively operable to stop flow of the cooling fluid from or to the heater core through the pair of fluid lines;

a temperature sensor operably connected to the cooling fluid flowing through the heater core and configured to provide an output indicative of temperature of the cooling fluid;

a housing mountable to the vehicle to travel with the vehicle; and a control device disposed in the housing and operably connected to the one or more valves and configured to receive an input indicative of a leak in the flow of the cooling fluid to the heater core and operate the one or more valves to stop the flow of the cooling fluid through the second pair of fluid lines based on the input, the control device being connected to the temperature sensor to receive the output indicative of temperature, the control device being configured to operate the one or more fluid pumps based on the output indicative of temperature, and the control device being further configured to operate the one or more fluid pumps when the water pump is not operating to circulate the cooling fluid and control the flow of the cooling fluid from the cooling system through the heater core.

27. The heat recovery system of claim 26 wherein the control device includes another output configured to control the engine so as to start and stop the engine generating heated cooling fluid based on the output from the temperature sensor.

28. The heat recovery system of claim 26 and further comprising a pressure sensor configured to provide an output indicative of pressure of the cooling fluid in the pair of fluid lines to the control device.

29. The heat recovery system of claim 26 wherein the one or more valves comprise a first valve fluidly coupled to a first fluid line of the pair of fluid lines and a second valve fluidly coupled to a second fluid line of the pair of fluid lines.

30. The heat recovery system of claim 26 and further comprising a first pair of fluid coupling ends and a second pair of fluid coupling ends couplable to the first pair of fluid coupling ends to form a quick disconnect fluid transfer coupling with the first pair of fluid coupling ends, the first pair of fluid coupling ends being fluidly connected to the heater core and the second pair of fluid coupling ends being connected to the first ends of the pair of fluid lines, and wherein the first pair of fluid coupling ends and the second pair of fluid coupling ends are configured to retain the cooling fluid in the heater core and the pair of fluid lines, respectively when the first pair of fluid coupling ends and the second pair of fluid coupling ends are disconnected from each other.

31. The heat recovery system of claim 30 and further comprising a cooling assembly operably coupled to the heater core to receive heat therefrom, the cooling assembly comprising a generator configured to receive the heat and heat cooling assembly fluid, an evaporator connected to the generator to receive heated cooling assembly fluid and cool the cooling assembly fluid to a liquid that is returned to the generator, and a cooling assembly blower configured to blow air on the evaporator.

32. The heat recovery system of claim 26 and further comprising a cooling assembly operably coupled to the heater core to receive heat therefrom, the cooling assembly comprising a generator configured to receive the heat and heat cooling assembly fluid, an evaporator connected to the generator to receive heated cooling assembly fluid and cool the cooling assembly fluid to a liquid that is returned to the generator, and a cooling assembly blower configured to blow air on the evaporator.

33. The heat recovery system of claim 26, wherein the control device is further configured to operate the one or more fluid pumps when the engine is not operating to circulate the flow of fluid through the heater core at a flow rate of 3-12 gallons per minute.

* * * * *